United States Patent [19]

Simashkevich et al.

[11] Patent Number: 4,534,106

[45] Date of Patent: Aug. 13, 1985

[54] METHOD FOR REPLACING DIELECTRIC MATERIAL AT THE HIGH-VALUE RESISTOR OF AN ELECTROSTATIC SPRAY GUN TO PREVENT CORONA DISCHARGE

[75] Inventors: Richard M. Simashkevich, Lorain; William J. Sharp, Wakeman, both of Ohio

[73] Assignee: Nordson Corporation, Amherst, Ohio

[21] Appl. No.: 539,086

[22] Filed: Oct. 5, 1983

[51] Int. Cl.[3] ..... H01C 17/02

[52] U.S. Cl. ..... 29/613; 29/402.04; 29/402.18; 29/460; 239/691; 184/15.1

[58] Field of Search ..... 184/15 R; 29/613, 614, 29/615, 402.04, 402.18, 455, 458, 460; 239/690, 691; 427/230

[56] References Cited

U.S. PATENT DOCUMENTS

| | | | |
|---|---|---|---|
| 2,266,702 | 12/1941 | Byers | 29/402.18 |
| 2,489,992 | 11/1949 | Tucker | 29/455 |
| 3,731,764 | 5/1973 | Workman | 184/15.1 |
| 3,884,329 | 5/1975 | Steffen | 184/15.1 |
| 4,182,490 | 1/1980 | Kennon . | |
| 4,241,880 | 12/1980 | Hastings . | |
| 4,273,293 | 6/1981 | Hastings . | |
| 4,335,851 | 6/1982 | Hastings . | |

FOREIGN PATENT DOCUMENTS

| | | | |
|---|---|---|---|
| 910280 | 11/1962 | United Kingdom | 29/613 |

*Primary Examiner*—Howard N. Goldberg
*Assistant Examiner*—P. W. Echols
*Attorney, Agent, or Firm*—Wood, Herron & Evans

[57] ABSTRACT

A method and apparatus for replacing spent dielectric material at the high-valued resistor in an electrostatic spray gun, having an insulating tube disposed within a bore formed in the gun barrel which receives the resistor encapsulated with spent dielectric material, comprises the steps of inserting a syringe apparatus into the insulating tube, dispensing new dielectric material contained within the syringe into the insulating tube while withdrawing the syringe therefrom, and then inserting a high voltage cable into the insulating tube to force the new dielectric material ahead of the cable. The new dielectric material encapsulates the resistor and forces the spent dielectric material between the insulating tube and gun barrel bore away from the resistor.

8 Claims, 4 Drawing Figures

METHOD FOR REPLACING DIELECTRIC MATERIAL AT THE HIGH-VALUE RESISTOR OF AN ELECTROSTATIC SPRAY GUN TO PREVENT CORONA DISCHARGE

RELATED APPLICATIONS

This application is related to a co-pending application Ser. No. 539,087, filed Oct. 5, 1983 and entitled "Method of Reducing Corona Discharge in an Electrostatic Spray Gun", invented by Donald R. Hastings, Glen A. Herstek and Don R. Scarbrough which is assigned to the same Assignee as this invention.

BACKGROUND OF THE INVENTION

This invention relates to electrostatic spray guns, and in particular a method for replacing spent dielectric material in the barrel of an electrostatic spray gun to reduce corona discharge therein.

Conventional electrostatic spray guns project fluid coating material such as paint, varnish, lacquer and the like in atomized or particulate form toward an object to be coated. The object to be coated is held at electrically ground potential and an electric charge is imparted to the coating material so that it will be electrostatically attracted to the object. In order to assure that a high percentage of the coating material ejected from the electrostatic spray gun is deposited on the object, high charging voltages, up to 120 kv, are typically applied to the coating material.

When spraying many of the coating materials in use today, including powders, a readily ignitable atmosphere results in the area of the coating operation. Energizing the high voltage electrostatic charging circuit associated with the spray gun causes energy to be capacitively stored in the electrically conductive components of the charging system. If the gun is brought too close to any grounded object, the possibility arises that a spark will jump between the high voltage circuit in the gun and the grounded object igniting the flammable atmosphere in the coating area. Many recent improvements in electrostatic spray guns have been directed to reducing incendevity resulting from the discharge of capacitively stored electrical energy, such as disclosed, for example, in U.S. Pat. Nos. 4,182,490; 4,241,880; 4,273,293; and 4,335,851, all assigned to the same Assignee as this invention.

One means of damping discharge of electrical energy capacitively stored in the charging circuit, disclosed in the prior patents mentioned above, is the provision of a high-value resistor in the barrel of the gun. The resistor is interposed between a high voltage cable carrying the electrical charge from a source, and a high voltage lead which communicates with the nozzle assembly of the gun in which the coating material is charged. The high-value resistor effectively reduces energy capacitively stored in the gun barrel when properly insulated.

It has been found, however, that if air is present in the area of the connection between the resistor and high voltage lead, a corona discharge can occur which attacks the high voltage connection and surrounding housing of the gun barrel. In order to eliminate air around the high voltage connection between the resistor and lead, it has been the practice in the prior art to completely cover the resistor with a dielectric material such as grease. According to this method, the resistor is first encapsulated with grease and then inserted into a bore formed in the gun barrel into contact with the high voltage lead. In some instances, additional grease is placed in the gun barrel bore prior to insertion of the resistor. This method of eliminating air gaps around the resistor and providing an uninterrupted layer of non-conductive grease between the resistor and the gun barrel, and around the high voltage connection between the resistor and lead, has not been entirely effective.

An improved method of completely insulating the resistor and its high voltage connections with dielectric material is disclosed in the above-mentioned co-pending U.S. patent application.

In accordance with the method of that invention, an insulating tube is inserted within a bore formed in the electrostatic gun barrel. The outside diameter of the tube is slightly less than the inside diameter of the bore so as to form a gap therebetween. A high voltage lead is disposed at the inner end of the bore, and a fitting is connected to the gun barrel at the outer end of the bore. A high-value resistor having a compliant contact such as a spring at one end, is inserted into the insulating tube so that it contacts the high voltage lead. The resistor and spring are not covered with grease at this point, and are surrounded with air contained in the insulating tube. A quantity or slug of flowable, dielectric material such as grease is then deposited in the insulating tube at its outer end adjacent the fitting. A high voltage cable, which carries the electrical charge to be applied to the coating material, is next inserted through the fitting and into contact with the grease in the insulating tube. The cable tightly fits within the insulating tube so that it pushes the grease ahead toward the resistor and spring. The cable is advanced until its leading end contacts the spring which urges the resistor against the high voltage lead. The cable is then connected to the fitting to retain it in place within the insulating tube.

The grease is forced by the cable over and around the spring and resistor, completely encapsulating both elements. A sufficient quantity of grease is provided so that the spring and resistor are entirely encapsulated and at least a portion of the grease is forced into the gap between the insulating tube and bore in the gun barrel. This assures that all of the air in the area of the resistor is forced ahead of the grease into the gap between the insulating tube and bore, away from the resistor. The grease effectively insulates the resistor and its connection to the high voltage lead to eliminate corona discharge thereat.

Typically, the insulating tube, resistor and grease are inserted in the gun barrel by the manufacturer prior to sale. The customer then inserts the high voltage cable into the insulating tube at the manufacturing site in preparation for a coating operation. From time to time the cable is removed to reposition the gun or perform maintenance and then later reinserted to begin another production run.

While the above-described method taught in U.S. patent application Ser. No. 539,087 mentioned above has proved to be effective in encapsulating the resistor with an initial slug of grease, difficulties have been encountered in replacing the spent grease with new grease when the cable is reinserted into the insulating tube. If too much or too little new grease is injected into the insulating tube, air gaps are formed in the area of the resistor causing corona discharge to occur. Replacement of spent grease which is initially placed on the resistor directly prior to insertion into the gun, as practiced in other prior art methods, also presents problems of creating unwanted air gaps in the vicinity of the resistor.

SUMMARY OF THE INVENTION

This invention is directed to a method and apparatus for replacing spent dielectric material encapsulating the high-valued resistor of an electrostatic spray gun with new dielectric material while preventing the formation of air gaps in the vicinity of the resistor.

According to the method of this invention, to perform maintenance or reposition the spray gun the high voltage cable is removed from the insulating tube of the gun barrel after having been initially inserted therein to encapsulate the high-valued resistor with a slug of dielectric material as described above and disclosed in the aforementioned co-pending U.S. patent application, Ser. No. 539,087. A syringe is provided comprising a hollow barrel containing a slug of new dielectric material and having a collar at one end, a plunger movable within the hollow barrel and a hollow tube also containing new dielectric material and being mounted to the collar of the barrel. The hollow tube of the syringe is inserted into the outer end of the insulating tube, and the plunger is then depressed to force the slug of new dielectric material from the hollow barrel, through the hollow tube and into the insulating tube as the hollow tube is withdrawn therefrom. As discussed in detail below, a predetermined quantity of new dielectric material is contained in the hollow barrel and injected through the hollow tube and into the insulating tube, flush with its outer end. The cable is then reinserted into the insulating tube forcing the slug of new dielectric material ahead of the cable.

The slug of new dielectric material is forced by the cable into contact with the spent dielectric material encapsulating the resistor. The spent dielectric material is forced between the resistor and insulating tube, and then into the gap between the insulating tube and gun barrel bore upstream toward the outer end of the insulating tube. The new dielectric material completely encapsulates the resistor, and also partially enters the gap between the insulating tube and bore so as to assure that no air gaps are formed between the new and spent dielectric material, or in the area of the resistor.

DESCRIPTION OF THE DRAWINGS

The structure, operation and advantages of this invention will become further apparent upon consideration of the following description taken in conjunction with the accompanying drawings wherein.

DETAILED DESCRIPTION OF THE INVENTION

Figure 1:
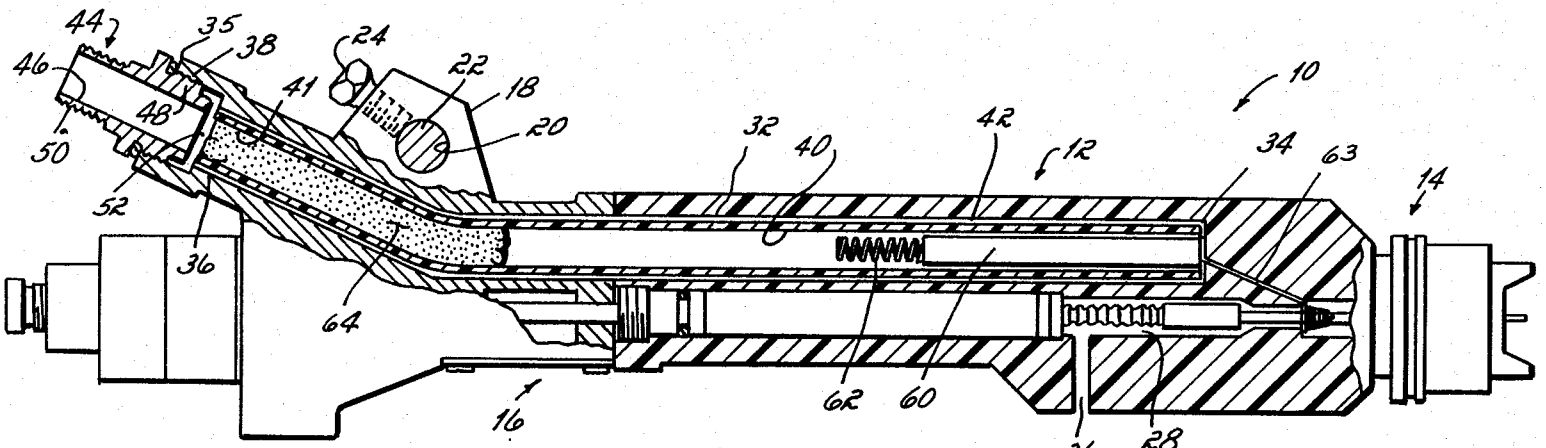
FIG. 1 is an axial cross-sectional view, partially in elevation, of an electrostatic spray gun having an insulating tube according to this invention.

The electrostatic spray gun 10 shown in the drawings is an air operated gun in which a stream of air impacts a stream of liquid coating to effect atomization of the liquid stream. Spray gun 10 includes a barrel assembly 12, a nozzle assembly 14 and an air delivery assembly 16. A flange 18 extends outwardly from the barrel assembly 12 and is formed with a bore 20 adapted to fit over an electrically grounded mounting rod 22. A set screw 24 extends through the flange 18 into locking engagement with the mounting rod 22 so as to mount the spray gun 10 in a desired position therealong.

Paint or some other spray coating material, which may be in the nature of a coating, varnish or lacquer, is supplied to the gun 10 under pressure from an external reservoir or tank (not shown) through an inlet port 26. The paint enters a longitudinal passageway 28 and travels to the nozzle assembly 14 where it is combined with an air stream supplied by the air delivery assembly 16. Just prior to or at the same time the paint is ejected from the nozzle assembly 14, a high voltage electrostatic charge is applied to the paint so that it is attracted to the object to be coated. The high voltage electrical energy is transmitted to the nozzle assembly 14 via an electrostatic charging circuit discussed in more detail below. A detailed description of the structure and operation of the barrel assembly 12, nozzle assembly 14 and air delivery assembly 16 may be found in U.S. Pat. No. 4,335,851, which is incorporated by reference herein.

An axially extending bore 32 is formed in the barrel assembly 12 having an inner end 34 and an outer end 36 which is spaced from the exterior surface 35 of the barrel assembly 12. A threaded bore 38 having a larger diameter than bore 32, extends from the outer end 36 of bore 32 to the exterior surface 35 of barrel assembly 12. An insulating tube 40, formed of plastic or another dielectric material, is inserted within the bore 32 and extends along its entire length terminating with an outer end 41. The insulating tube 40 has an outside diameter which is preferably about 0.050 inch smaller than the inside diameter of the bore 32 forming a gap 42 therebetween. A fitting 44 is provided having a central bore 46 and threaded male sections 48, 50 at opposite ends. The threaded section 48 of fitting 44 is adapted to be tightened within the threaded bore 38 in the barrel assembly 12, forming a space 52 between the outer end 41 of the insulating tube 40 and fitting 44. The gap 42 between the insulating tube 40 and bore 32 extends from the inner end 34 of bore 32 and terminates at the space 52.

As discussed above, the spray gun 10 includes a high voltage electrostatic charging circuit for applying an electrostatic charge to the paint to be applied to an object. The charging circuit comprises, in part, a high voltage cable 54, a resistor 60 having a compliant contact such as a coil spring 62 attached at one end, and a high voltage lead 63. The high voltage cable 54, connected to a source of electrical energy (not shown), is adapted to be inserted through the fitting 44 and into the insulating tube 40 within barrel assembly 12. An electrically conductive disk 56 is attached to the end of cable 54 inserted within the insulating tube 40, and a rotatable female fitting 58 is mounted to the outer surface of cable 54 at a location spaced from the disk 56. The high voltage lead 63 is mounted within the barrel assembly 12 and one end enters the bore 32 at its inner end 34 and extends into the insulating tube 40. In order to damp the discharge of electrical energy capacitively stored in the barrel assembly 12 and cable 54, the resistor 60 and coil spring 62 are disposed within the insulating tube 40 and connected in series between the high voltage lead 63 and cable 54. In the assembled position of cable 54 within insulating tube 40, discussed in more detail below, the disk 56 contacts coil spring 62 and urges resistor 60 into electrical contact with the high voltage lead 63. The remainder of the high voltage electrostatic charging circuit conveys the electrical charge from lead 63 to the nozzle assembly 14, and is discussed in detail in U.S. Pat. No. 4,335,851.

The high charging voltage carried by cable 54, which may be on the order of 120 kv, can result in corona discharge between the resistor 60, its high voltage connections to cable 54 and lead 63, and the surrounding area of the barrel assembly 12, if no insulation is provided therebetween. The presence of air within bore 32 in the area of resistor 60 permits a corona discharge that can seriously deteriorate the barrel assembly 12 and the high voltage connections over a period of time. It has been recognized that a coating of grease around the resistor 60, coil spring 62 and their connections to cable 54 and lead 63 provides effective insulation and prevents corona discharge. However, prior efforts to obtain a continuous coating or encapsulation of the resistor 60 and coil spring 62 with grease have not been entirely successful.

Initially, an original quantity or slug of grease 64 encapsulates the resistor 60 and spring 62, in accordance with the method described in U.S. patent application Ser. No. 539,087 identified above. No pockets of air are left in the area between the resistor 60 and barrel assembly 12 thereby eliminating corona discharge thereat. The insulating tube 40 is first inserted within the bore 32 of barrel assembly 12 with the gap 42 of about 0.050 inch provided therebetween. The resistor 60 is then inserted into the insulating tube 40 so that one end contacts the high voltage lead 63 and the end attached to coil spring 62 faces toward the outer end 36 of bore 32. At this point, no grease or other noninsulating substance has been applied to the resistor 60 or coil spring 62 and only air is contained within the insulating tube 40 and gap 42 between the gun barrel bore 32 and insulating tube 40.

A quantity or slug of a grease 64 sufficient to fully encapsulate the resistor 60 and coil spring 62 is filled or injected into a portion of the insulating tube 40, flush with its outer end 41. In a standard Model AN-9 electrostatic spray gun, manufactured and sold by the Assignee of this invention, the quantity of grease 64 needed to fully encase the resistor 60 and coil spring 62 is preferably about 7.8 to 8.2 cubic centimeters. In the AN-9 Model electrostatic spray gun, 7.8 to 8.2 cc of grease 64 extends about 3 inches into the insulating tube 40 from its outer end 41. Of course, electrostatic spray guns having larger or smaller gun barrel dimensions, and gun barrel bores, would require different quantities of grease to fully encapsulate the high-value resistor and spring. The Assignee's Model AN-9 gun, and the quantity of grease 64 it requires, are discussed herein to illustrate the method of this invention.

Once the slug of grease 64 is in place at the outer end 41 of insulating tube 40, the threaded male section 48 of fitting 44 is tightened within the threaded bore 38 in the barrel assembly 12. Preferably, an O-ring seal 68 is disposed between the fitting 44 and threaded bore 38 to provide a fluid tight seal therebetween. Although a threaded connection between fitting 44 and bore 38 is shown herein, it is contemplated that other fluid-tight connections therebetween such as standard quick-disconnect connections could also be used.

The final step in providing an initial coating of grease 64 is the insertion of cable 54 into the insulating tube 40 so that the conductive disk 56 at its inward end contacts the coil spring 62 and urges the resistor 60 into contact with the high voltage lead 63. In addition to completing the high voltage electrostatic charging circuit of the spray gun 10, insertion of the cable 54 into the insulating tube 40 forces the slug of grease 64 ahead of the cable 54 so that the grease 64 encases both the coil spring 62 and resistor 60. Preferably, the cable 54 tightly fits within the insulating tube 40 with a clearance therebetween of only approximately 0.005 inch. Thus, as the cable 54 moves within insulating tube 40, the grease 64 forces any air within the insulating tube 40 between the resistor 60 and insulating tube 40, and then outwardly into the gap 42 between insulating tube 40 and the barrel assembly bore 32. The cable 54 is locked in place within insulating tube 40 by the female fitting 58, mounted to the exterior cover of cable 54, which is rotatable so as to tighten over the threaded male section 52 of the fitting 44. Preferably, an O-ring (not shown) or metal-to-metal seal is provided between female fitting 58 and the barrel assembly fitting 44.

Figure 2:
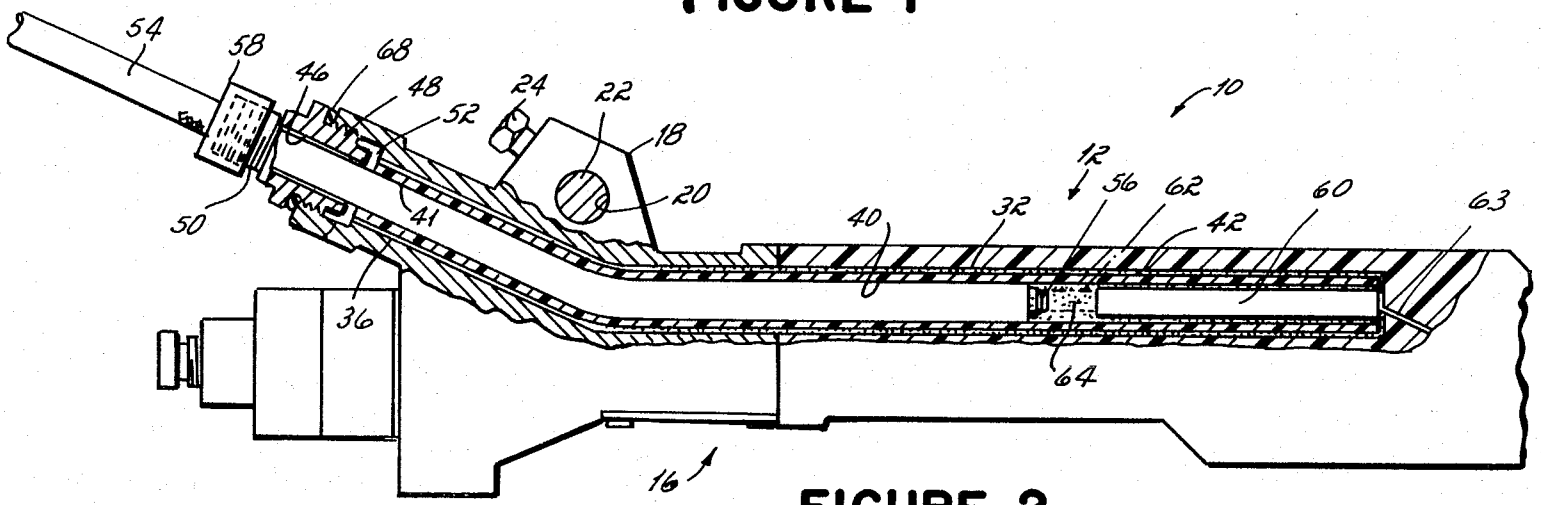
FIG. 2 is a view of the electrostatic spray gun shown in FIG. 1 with the high voltage cable inserted within the insulating tube to encapsulate the resistor with an initial slug of grease.

It has been found that corona discharge in prior art electrostatic spray guns occurs most commonly at the high voltage connections between the high-valued resistor and the cable and lead. Deterioration by corona attack of such high voltage connections, and the barrel assembly in the vicinity of such connections, has been a pervasive problem. One aspect of this invention is that the resistor 60 and coil spring 62 are completely encapsulated with an initial quantity or slug of grease 64, particularly at their connections to cable 54 and lead 63. As shown in FIG. 2, the slug of grease 64 provided is more than required to completely encapsulate the spring 62 and resistor 60. Excess grease 64 is forced between the exterior of the resistor 60 and interior of the insulating tube 40 into the gap 42 between the insulating tube 40 and bore 32 in barrel assembly 12. The grease 64 is forced around the forward edge of the resistor 60 and flows upstream within the gap 42 toward the outer end 41 of insulating tube 40. Any air which was initially between the resistor 60 and insulating tube 40, or in the gap 42, is thus effectively forced upstream along the gap 42.

Preferably, the central bore 46 of fitting 44 has an interior diameter about 0.030 greater than the exterior diameter of cable 54. This enables the air trapped within the gap 42 to flow into the space 52 fitting 44 and insulating tube 40, and then outwardly from the spray gun 10 through the central bore 46 of the fitting 44 along the side the cable 54.

To perform maintenance on the spray gun 10 or cable 54, or to reposition the spray gun 10, the cable 54 is removed from insulating tube 40. The resistor 60 remains in the insulating tube 40 with the slug of now spent grease 64 still encapsulating the resistor 60, coil spring 62 and the high voltage connection between the resistor 60 and lead 63. Prior to reusing the spray gun 10, the spent grease 64 must be replaced with a new slug of grease without creating air gaps in the area of the resistor 60. Prior art attempts to accomplish the replacement of spent grease at the high-valued resistor in an electrostatic spray gun have met with limited success. If too little grease is placed in the insulating tube 40, the resistor 60 and coil spring 62 will not be completely encapsulated. Even if a sufficient quantity of grease is provided, it has been found that the grease must be injected or filled flush with the outer end 41 of the insulating tube 40 so that an air gap is not created between the grease and the end of cable 54 when the cable 54 is reinserted into the spray gun 10.

Figure 3:
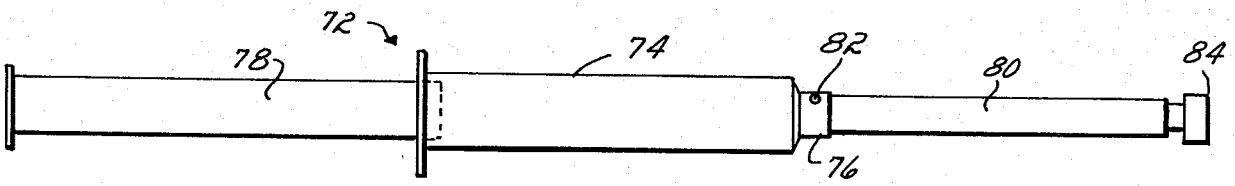
FIG. 3 is a side view of the grease dispensing syringe of this invention.
Figure 4:
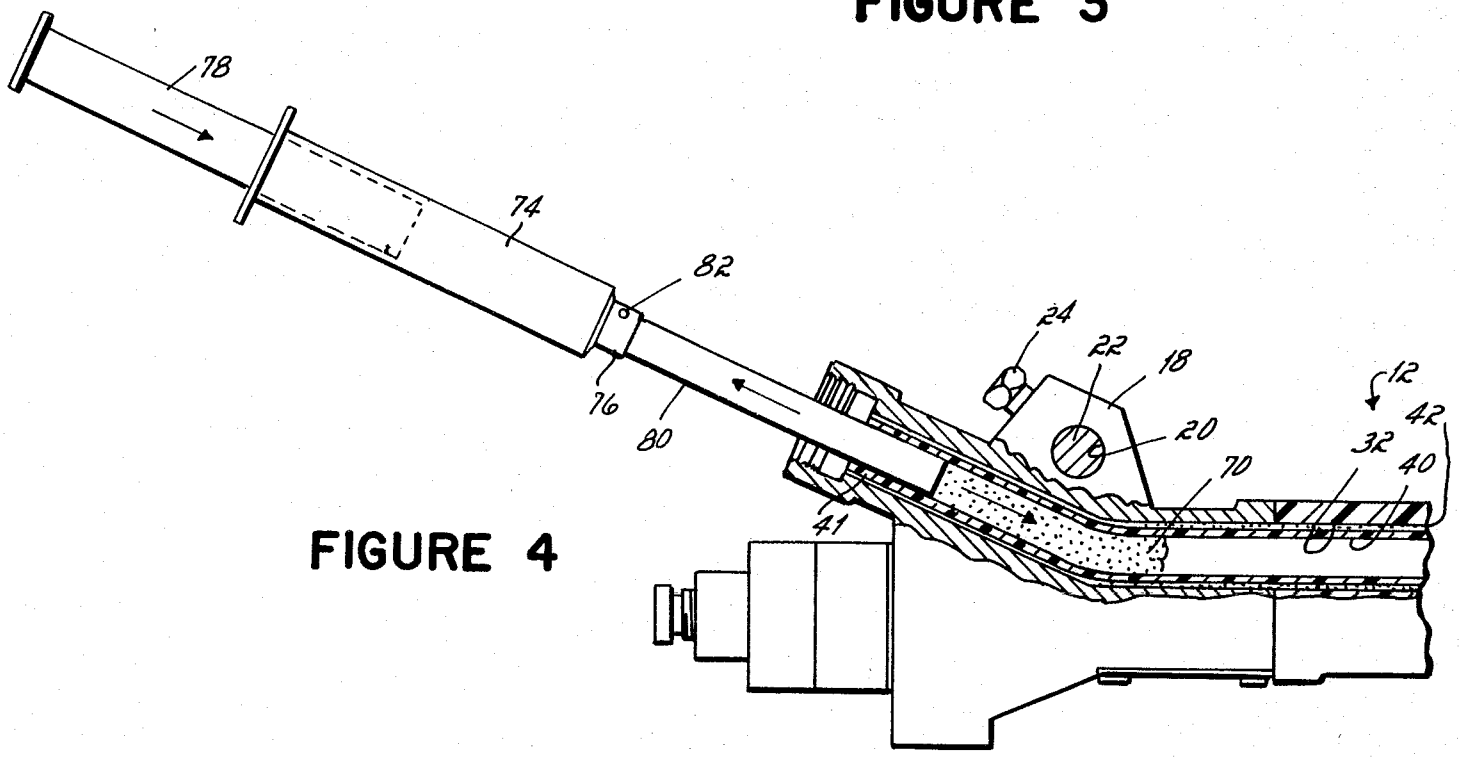
FIG. 4 is a partial view of the electrostatic spray gun in FIG. 1 with the syringe dispensing a new slug of grease into the insulating tube thereof to replace the spent grease.

Referring now to FIGS. 3 and 4, a method and apparatus in accordance with this invention is illustrated for inserting the proper quantity of a new slug of grease 70 into the insulating tube 40 flush with its outer end 41 for replacement of the spent grease 64. A syringe 72 is provided which comprises a hollow barrel 74 having a collar 76 at one end, a plunger 78 movable within the barrel 74 and an elongate hollow tube 80 attached by a pin 82 to the collar 76 of barrel 74. The hollow tube 80 has an outside diameter smaller than the inside diameter of insulating tube 40, and, for the spray gun 10 illustrated in the drawings, has a length of about 3 inches. The barrel 74 contains a slug of new grease 70, and the hollow tube 80 also is filled with new grease which is held therein by a plug 84 insertable within the end of tube 80. The plunger 78 is movable within barrel 74 toward its collar 76 to urge the slug of grease 70 out of the barrel 74, thus forcing the same quantity of new grease out of the hollow tube 80. As mentioned above, for purposes of discussion the drawings illustrate a Model AN-9 electrostatic spray gun manufactured by the Assignee of this invention. For that model spray gun, approximately 7.8–8.2 cc of grease is required to fully encapsulate the spring 62, resistor 60 and their high voltage connections to cable 54 and lead 63. Thus, the barrel 74 of syringe 72 is filled with a quantity or slug of new grease 70 in the range of about 7.8–8.2 cc.

Referring now to FIG. 4, the syringe 72 is shown depositing the new grease 70 into the insulating tube 40. Initially, the fitting 44 is removed and the hollow tube 80 is completely inserted within the insulating tube 40 with the plunger 78 in a retracted position within barrel 74. At this point, a quantity of air resides in the insulating tube 40 between the spent grease 64 and the end of hollow tube 80. Since the hollow tube 80 is formed with an outside diameter smaller than the inside diameter of insulating tube 40, at least some of the air within insulating tube 40 is forced along the side of hollow tube 80 and out the central bore 48 of the fitting 44. Not all of the air within insulating tube 40 exits the spray gun 10 with the insertion of hollow tube 80 therein, and such air will be compressed within insulating tube 40 to some extent.

The plunger 78 is then depressed to force the 7.8–8.2 cc of new grease 70 out of the barrel 74 and into the hollow tube 80. In turn, the new grease contained in the hollow tube 80 is forced into the insulating tube 40. As the plunger 78 is depressed and the new grease 70 is deposited within the insulating tube 40, the syringe 72 is simultaneously withdrawn therefrom. For the Model AN-9 electrostatic spray gun 10 illustrated in the drawings, it has been found that a hollow tube 80 about 3 inches in length deposits the new grease 70 the proper distance within insulating tube 40 so that the new grease 70 is flush with the upper end 41 thereof when the syringe 72 is completely withdrawn. It is important that the new grease 70 is flush with the upper end 41 of insulating tube 40 so that no air gap is formed between the new grease 70 and cable 54 when it is reinserted into the insulating tube 40. Of course, spray guns of different size and capacity than the Assignee's Model AN-9 gun 10 would require a different quantity of new grease 70 and the length of the syringe tube 80 would have to be adjusted accordingly to assure that the new grease 70 is deposited flush with the upper end 41 of insulating tube 40.

The spray gun 10 is now ready for insertion of the cable 54 in preparation for another production run. The fitting 44 is replaced and cable 54 is inserted therethrough and contacts the new grease 70 at the upper end 41 of insulating tube 40. Since the new grease 70 is flush with the upper end 41 of insulating tube 40, no air gap is created between the cable 54 and the new grease 70. The cable 54 forces the new grease 70 ahead of the cable 54 compressing the air remaining in insulating tube 40 against the now spent grease 64. The cable 54 is advanced into contact with the spring 62, forcing the spent grease 64 between the resistor 60 and insulating tube 40 and then outwardly through the gap 42 between insulating tube 40 and the gun barrel bore 32. The spent grease 64 flows upstream within gap 42, into the space 52 between the outer end 41 of insulating tube 40 and the fitting 44, and then outwardly from the spray gun 10 along the cable 54 through the central bore 46 of fitting 44. The air within insulating tube 40, originally captured between the slug of new grease 70 and the spent grease 64, is forced by the new grease 70 along the same path as the spent grease 64. The new grease 70 completely encapsulates the spring 62, resistor 60 and their high voltage connections to the cable 54 and lead 63. At least a portion of the new grease 70 flows between the resistor 60 and insulating tube 40, and then into the gap 42 between insulating tube 40 and gun barrel bore 32. This assures that neither the spent grease 64, nor any air, remains in the vicinity of the resistor 60 with the cable 54 in place. Once the cable 54 is completely inserted within insulating tube 40, its female fitting 58 is threaded onto the male section 50 of fitting 44 to secure the cable 54 in place.

The method and apparatus of this invention thus provides an accurate means of injecting new replacement grease into a spray gun for encapsulating its high voltage resistor and replacing spent grease, without creating air gaps in the vicinity of the resistor which could lead to corona discharge.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A method of replacing spent dielectric material at the resistor of an electrostatic spray gun to prevent corona discharge comprising the steps of:

inserting an insulating tube within a bore formed in said spray gun, said insulating tube having a smaller outside diameter than the inside diameter of said bore forming a gap therebetween;

positioning a resistor within said insulating tube, said resistor being encapsulated with a first slug of dielectric material;

dispensing a new slug of said dielectric material within said insulating tube;

inserting a high voltage cable into said insulating tube so as to force said new slug of dielectric material ahead of said cable, said new slug of dielectric material encapsulating said resistor and forcing at least a portion of said first slug of dielectric material into said gap between said insulating tube and said bore.

2. The method of claim 1 further including the step of:

providing means for dispensing said second slug of dielectric material within said insulating tube, said means comprising a syringe having a hollow barrel containing a new slug of dielectric material, a plunger movable within said hollow barrel, and a hollow tube mounted to said hollow barrel, said plunger being operable to force said new slug of dielectric material from said hollow barrel through said hollow tube into said insulating tube.

3. The method of claim 2 further including the steps of:

inserting said hollow tube of said syringe into one end of said insulating tube;

depressing said plunger so as to force said second slug of dielectric material out of said hollow barrel, through said hollow tube and into said insulating tube; and simultaneously withdrawing said hollow tube from said insulating tube while depressing said plunger thereby filling said one end of said insulating tube flush with said second slug of dielectric material.

4. The method of claim 2 in which said hollow tube is approximately 3 inches in length.

5. The method of claim 2 in which said hollow barrel is formed with a collar, said hollow tube being attached to said collar by a pin.

6. A method of replacing spent grease at the high-value resistor of an electrostatic spray gun to prevent corona discharge comprising the steps of:

inserting an insulating tube having an inner end and an outer end within a bore in the barrel of said spray gun, said insulating tube having a smaller outside diameter than the inside diameter of said bore forming a gap therebetween;

positioning a resistor within said insulating tube adjacent said inner end thereof;

filling a portion of said insulating tube with a first slug of grease;

inserting a cable within said insulating tube so as to force said first slug of grease ahead of said cable, said first slug of grease encapsulating said resistor;

removing said cable from said insulating tube;

dispensing a new slug of grease within said insulating tube flush with said outer end thereof; and reinserting said cable into said insulating tube so as to force said new slug of grease ahead of said cable, said new slug of grease encapsulating said resistor and forcing said first slug of grease into said gap between said insulating tube and said bore.

7. The method of claim 1 further including the steps of:

providing a fitting in said gun barrel adjacent said outer end of said insulating tube, said fitting including a central bore having an inside diameter greater than the outside diameter of said cable forming a space therebetween, said cable being inserted into said insulating tube through said fitting, said first slug of grease being forced into said gap between said insulating tube and said bore in said gun barrel, and then outwardly from said spray gun through said space between said fitting and said cable.

8. The method of claim 6 in which O-ring seals are disposed between said gun barrel and said fitting to form a fluid-tight seal therebetween.

* * * * *